US005683340A

United States Patent [19]

Belias et al.

[11] Patent Number: 5,683,340

[45] Date of Patent: Nov. 4, 1997

[54] METHOD OF MAKING EASY OPEN THERMOPLASTIC BAG

[75] Inventors: William P. Belias, Fairport; Edward M. Bullard, Rochester; Carl R. Letendre, Fairport, all of N.Y.

[73] Assignee: Tenneco Plastics Company, Evanston, Ill.

[21] Appl. No.: 392,645

[22] Filed: Feb. 23, 1995

[51] Int. Cl.[6] ..... B31B 23/02

[52] U.S. Cl. ..... 493/195; 493/196; 83/333; 83/428

[58] Field of Search ..... 493/189, 193, 493/194, 195, 196, 197, 198, 199, 200, 201, 212, 214, 226, 230, 237, 238, 916, 926, 934, 224; 83/333, 428, 53

[56] References Cited

U.S. PATENT DOCUMENTS

| | | | |
|---|---|---|---|
| 3,931,886 | 1/1976 | Yamauchi | 206/390 |
| 3,961,743 | 6/1976 | Hollowell | 229/62 |
| 3,979,050 | 9/1976 | Cilia | 229/66 |
| 4,125,220 | 11/1978 | Suominen | 229/54 R |
| 4,174,657 | 11/1979 | Suominen | 93/35 H |
| 4,216,705 | 8/1980 | Achelpohl | 93/33 H |
| 4,266,112 | 5/1981 | Niedermeyer | 216/121 |
| 4,345,712 | 8/1982 | Gim | 229/62 |
| 4,368,051 | 1/1983 | Lehmacher | 493/11 |
| 4,445,230 | 4/1984 | Spadaro | 383/7 |
| 4,568,322 | 2/1986 | Piggott | 493/461 |
| 4,609,366 | 9/1986 | Ley | 493/22 |
| 4,614,138 | 9/1986 | Altman | 83/51 |
| 4,679,474 | 7/1987 | Lambrecht | 83/171 |
| 4,890,736 | 1/1990 | Greyvenstein | 206/390 |
| 4,925,438 | 5/1990 | Wagner | 493/194 |
| 4,938,608 | 7/1990 | Espinosa | 383/7 |
| 5,041,317 | 8/1991 | Greyvenstein | 428/35.5 |
| 5,045,042 | 9/1991 | Rutledge | 493/225 |
| 5,215,275 | 6/1993 | Gold | 242/56.8 |
| 5,246,110 | 9/1993 | Greyvenstein | 206/390 |
| 5,393,294 | 2/1995 | Jobst | 83/51 |
| 5,421,802 | 6/1995 | Landeck | 493/22 |

FOREIGN PATENT DOCUMENTS

| | | | |
|---|---|---|---|
| 3336145 | 4/1985 | Germany | 493/196 |

*Primary Examiner*—Joseph J. Hail, III
*Assistant Examiner*—Christopher W. Day
*Attorney, Agent, or Firm*—Arnold, White & Durkee

[57] ABSTRACT

There is provided a thermoplastic film bag having at least two integral members that facilitate opening the bag. The bag is manufactured from a flattened tube of thermoplastic material which may be distinctively severed along independent phase shifted sinusoidal oscillating paths down the center of the collapsed tube. The bag may have two opposed tie members which are offset from the vertical center axis of the bag and from each other. The tie members may be grasped and pulled apart to facilitate the easy opening of the bag. The tie members may then be tied together to form a strong member by which the bag may be picked up and carried. In alternate embodiments the shape of the integral tie members can be modified to create a bag having only the easy open feature with no tie members. A method for making the bag is also described.

8 Claims, 11 Drawing Sheets

METHOD OF MAKING EASY OPEN THERMOPLASTIC BAG

FIELD OF THE INVENTION

The invention relates to a thermoplastic film bag manufactured with two integral tie handles that facilitate opening the bag. The handles have a generally sinusoidal shape and are located on opposing bag layers of thermoplastic material. The handles are in opposite phase with each other. The bag can be easily opened by grasping the leaves and pulling them in opposite directions which in turn separates the opposing bag layers of thermoplastic material. After the bag is loaded the handles may be used to close the bag securely and form a handle for carrying the bag to be disposed.

BACKGROUND OF THE INVENTION

The use of thermoplastic bags for a number of household and industrial uses has gained wide acceptance. Many of these bags are constructed from a simple structure having two layers of thermoplastic film which are joined along three sides and having a mouth opening formed along the fourth side. This basic structure has been adapted to a wide range of sizes and configurations that vary with the intended end use of the bag. Advancements in resin technology have enabled manufacturers to produce bags of ever increasing strength, puncture resistance, and resistance to tear while downgaging the film used to make the bags. The end result has been a significant savings in material costs and improvement in the quality of the product made available to the consumer.

The present invention is concerned with addressing some of the problems encountered with bags intended primarily for holding garbage or yard waste. However, it may be adapted for use in grocery stores to hold fresh produce or bulk foods. Both these types of bags have been provided in the form of a collapsed, continuous roll of bags. The bags on the roll are separated by perforations so that a consumer can unwind and tear off individual bags from the roll. These bags have also been sold in non roll form wherein individual bags are separated and folded. In either case downgaging the bag film has made it difficult for consumers to open the bag mouth because the very thin film layers tend to adhere to each other. Another problem has developed from the advancements in perforation technology that permit consumers to sever bags very cleanly from a roll of bags. The separation can be so neat that consumers often frustrate themselves attempting to open the bottom sealed end of the bag. That bottom end often closely resembles the top open mouth end of the bag. Customer perception of the bag is often negatively affected by the difficulties encountered locating the top of the bag and then separating the bag film layers for filling.

Garbage bags may be provided with a means to close the bag securely after loading. Typically such bags are provided with a separate closure means in the form of a plastic or metal tie device. Such devices are well known and require that the neck of the bag be bunched together by the user. This approach has the disadvantage of requiring that a number of small closures be inventoried and tracked by the user. Also, this type closure results in the loss of some amount of useable bag volume to the need to gather the neck of the bag for tying off.

U.S. Pat. No. 3,979,050 to Cilia which discloses a multiply plastic film bag comprising a first ply of flat flexible plastic superimposed over a second ply of flat flexible plastic film. At least a portion of the first ply of film defining the openable end of the bag is distorted to separate at least a portion of the confronting face of the first ply of film from the opposed confronting second ply of film. The distorted portion of the first ply of film provides means for separating the confronting faces of the first and second plies of film. Heat may be used to distort the first ply in order to create the separation between plies. This distortion would be difficult to control during actual manufacture of the film. Moreover, heat shrinkable film is required, and this requirement places a substantial limitation on the range of materials that can be used to make the bag.

U.S. Pat. No. 5,246,110 to Greyvenstein discloses a refuse bag joined at three sides and an open fourth side which includes projecting tie parts that can readily be tied by hand. The tie parts are rounded peaks separated by convex valleys. Each peak has side portions and a top which has a convex part including convex transitional portions connected to the side portions which otherwise connect to the valleys. Preferably the peaks and valleys form a sinusoid. This design is disadvantaged by the tendency of the tie parts to be welded together by the cutting action forming them. This cut welding inhibits the opening of the bag. The handles of this bag are in exact alignment when the bag is in lay flat condition.

U.S. Pat. No. 4,890,736 also to Greyvenstein discloses a roll of thermoplastic material from which is formed a plurality of refuse bags. Pairs of heat seals are formed transverse to the direction of the bag at about bag length distances apart. The heat seals are separated by perforations. Every embodiment of the bag requires the formation of a transverse, wave-like cut between the pairs of heat seals resulting in the formation of four cut-outs and four projecting tie parts.

U.S. Pat. No. 5,215,275 to Gold describes a process for making a roll of plastic bags. The bags are made from a two-ply web sealed along its edges. Essentially non-coincident perforations are made in the top edges of each bag. The perforation in the first ply is straight and the perforation in the second ply is curved. It is disclosed that the non alignment of the perforations makes the bag easy to open.

U.S. Pat. No. 4,125,220 to Suominen discloses a plastic shopping bag having a reinforced handle. The handle has a symmetrical wave configuration and is reinforces by a pair of reinforcing strips glued to either side of the collapsed tube of material from which the bag is made. After attachment of the reinforcing strips, a cutter cuts through every layer of bag material along a sinusoidal path.

SUMMARY OF THE INVENTION

According to this invention a novel easy to open plastic bag and a method of forming the bag is provided. The method comprises the steps of (a) cutting opposing sides of a flattened thermoplastic film tube by passing the tube in the machine direction through a cutting section comprising two cutting means with at least one of said cutting means oscillates from side to side in the transverse direction, separating the tube into two halves, each half being capable of being collapsed and laid flat so as to form a sheet material having a top layer, a bottom layer, a straight folded edge and a skewed-cut edge, wherein the section of the sheet material bordering the skewed-cut edge includes portions of said top layer which do not overlap with said bottom layer and portions of said bottom layer which do not overlap with said top layer;

(b) collapsing each of the halves from step (a) so as to form two sheet materials each, when laid flat, having a top layer, a bottom layer, a straight folded edge and a skewed-cut edge, wherein the section of the sheet material bordering the skewed-cut edge includes portions of the top layer which do not overlap with the bottom layer and portions of the bottom layer which do not overlap with the top layer; and (c) forming pairs of transverse heat seals at about bag-width distances apart in the sheets from step (b), wherein, when the sheets are laid flat, the sections of the sheet material bordering the skewed-cut edges between successive heat seals each include at least one portion of said top layer which does not overlap with the bottom layer and at least one portion of the bottom layer which does not overlap with the top layer.

The invention further comprises severing the sheets between the heat seals of step (c) so as to form individual bags, which when in lay flat condition, comprise a top layer, a bottom layer, a folded straight closed edge, a skewed-cut open edge and two heat sealed side edges, wherein the side edges are bordered by heat seals formed in step (c), and wherein the sections of the bag material bordering the skewed-cut open edge include portions of the top layer which do not overlap with the bottom layer and portions of the bottom layer which do not overlap with the top layer.

In one embodiment the two streams of sheet material are wound convolutely into two rolls of bags. The weakened area between the pairs of transverse heat seals is a perforation in this embodiment. In an alternative embodiment the weakened area between the pair of heat seals is severed to form individual bags. The individual bags are then folded, stacked and boxed for consumer use.

The present invention also relates to a thermoplastic bag comprising a first layer and a second layer, the first layer and the second layer being joined along three sides to form an open mouth, the sides intersecting with the open mouth being heat sealed, wherein the boundaries of the layers along the mouth of the bag are such that, when the bag is in lay flat condition, at least one portion of the first layer does not overlap with the second layer and at least one portion of the second layer does not overlap with the first layer.

According to another aspect of this bag the tie members cooperate to open the thermoplastic garbage bag such that when the first integral tie handle and the second integral tie handle are pulled apart the first layer is separated from the second layer and the thermoplastic bag is rendered open for filling.

As pointed out in greater detail below, this bag provides important advantages. Every embodiment of the bag contains at least a portion of a first layer that does not overlap the second layer and at least a portion of the second layer that does not overlap the first layer. Accordingly, the bag does not suffer from being difficult to open due to cut welding of the thermoplastic material during manufacture. As the film used to make thermoplastic bags has been steadily downgaged, the bag film layers have developed a tendency to cling to each other and thus become very difficult to open. This invention avoids that problem by providing single layer film regions that when pulled apart will open the bag for filling. If of sufficient size the single layer film regions may act as tie members which may be tied together to close the bag and to form one wide continuous carrying handle. The single carrying handle can be easily located by the consumer and makes the bag easy to pick up and transport.

Therefore it is an object of this invention to provide a thermoplastic bag the top of which is not affected by cut blocking and is thus easy to open for filling.

It is another object of this invention to provide a thermoplastic bag having single film layer tie members that function to not only open the bag but also to close the bag and provide a carry handle therefor.

Yet another object of this invention is to provide a bag which signals to the consumer which end of the bag should be opened for filling.

Still another object of this invention is to provide a bag having single film layer undulations that facilitate the easy opening of the bag.

The foregoing and other objects, features and advantages of the invention will be better understood from the following more detailed description to include the drawings herein and appended claims.

DESCRIPTION OF THE PREFERRED EMBODIMENT

Figure 1:
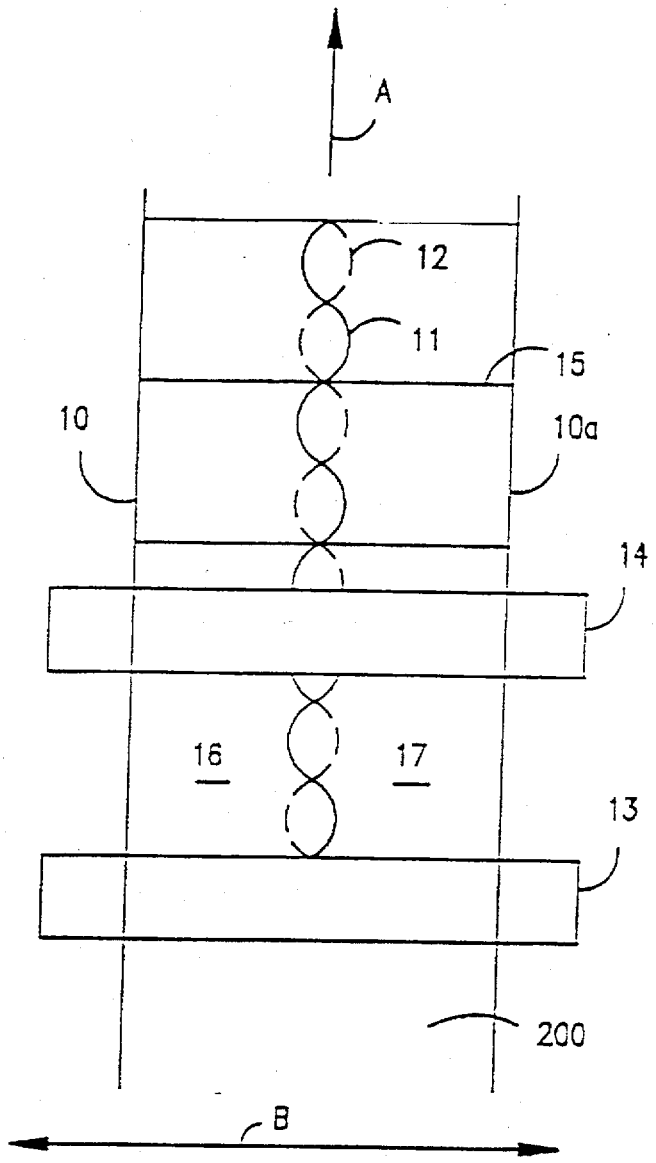
FIG. 1 is a view of the collapsed tube of thermoplastic material showing the severing and heat sealing steps.

Referring now to FIG. 1 it can be seen that the bag of the present invention is formed from a longitudinal flattened tube 600 of thermoplastic material. This thermoplastic material can be any one well known to one of ordinary skill in the art and as more specifically detailed herein below. The longitudinal tube moves in the machine direction depicted by arrow A for processing. In this art the machine direction refers to the line of travel of the tube through the various kinds of processing equipment used to transform the tube into a finished product. Movement in the machine direction will always be parallel to the longitudinal axis of the tube. The transverse direction is another art accepted term and is represented by arrow B in FIG. 1. This term is used to describe any processing step that is generally at a right angle to machine direction.

Figure 1A:
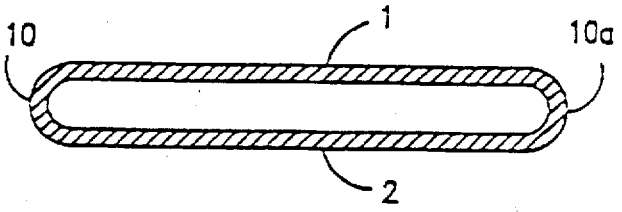
FIGS. 1A, 1B, and 1C show the steps of severing the flattened tube of thermoplastic material to form the bag of the present invention.
Figure 1B:
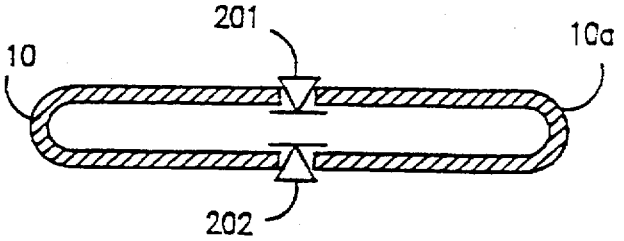

FIG. 1A shows that in the flattened condition the tube has a first upper layer 1 and an opposing layer 2 which are joined at folded edges 10, 10*a*. Referring to FIG. 1, the method of the present invention commences with passing the flattened tube 200 in the machine direction through a cutting section 13. At the cutting section (FIG. 1B) two independently traveling cutting means 201, 202 operate form opposite sides of the tube to sever the tube into two halves 16 and 17 (See FIG. 1). Though it is not impossible to perform this novel cutting step with a single cutting means, it would be extremely impractical to do so. At least one of the cutting means oscillates from side to side in the transverse direction B as the tube travels past it in the machine direction A. In a preferred embodiment shown in FIG. 1, the non-superposed paths 11,12 of both cutting means follow a sinusoidally oscillating course along the machine direction of the tube. Path 12 is shown as a dashed line to better differentiate it from path 11. These paths will form the leading edges of the bags.

Figure 1C:
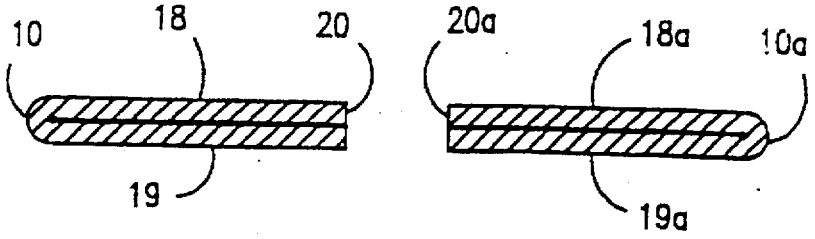

After leaving the cutting section, tube halves 16,17 are then collapsed to form two continuous sheet materials each having, when laid flat, two layers of thermoplastic material joined by folded edges 10, 10*a*. A cross-section of the severed tube halves after they exit the severing section is shown in FIG. 1C. There it can be seen that each half forms a top layer 18, 18*a*, an opposing bottom layer 19, 19*a*, a folded edge 10, 10*a*, and a skewed cut mouth edge 20, 20*a*.

Returning to FIG. 1 the oscillation of the cutting means is shown taking place about the centerline of the tube of thermoplastic material. However, it would be possible to offset the cutting means to either side of the tube centerline but in the preferred embodiment the severing station is centered on the tube.

As stated above, at least one and preferably both of the cutting means follows a path of generally sinusoidal motion that can be described as simple harmonic oscillation or as being a harmonic oscillator. If two sinusoidal cutting paths are utilized then the oscillations thereof may be phase shifted. In either case the section of the sheet material bordering the skewed-cut edges 20, 20*a* includes portions of the first layer which do not overlap with the second layer and portions of the second layer which do not overlap with the first layer. In a preferred embodiment, the result of the independent severing of each layer is the formation of an alternating series of opposing laterally offset integral tie members as will be described in more detail herein below. These novel tie members comprise a single layer of thermoplastic material when the bags are in a lay flat condition.

Figure 1D:
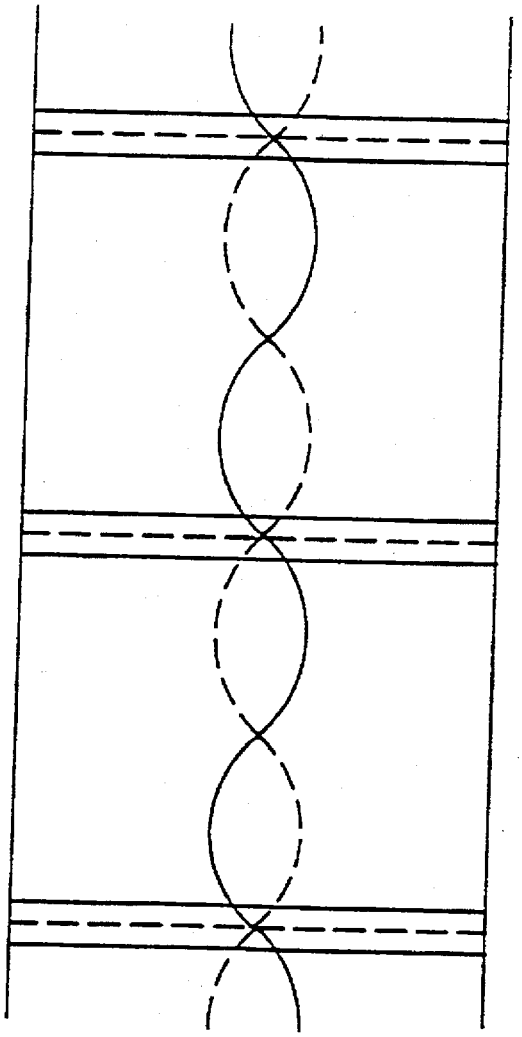
FIG. 1D shows the collapsed tube of thermoplastic material after the heat sealing and forming areas of weakness steps have been performed.

After the first layer and the second layer have been severed, the collapsed tube halves travel through a sealing station 14 where transverse heat seals 15 are formed across the tube halves. The placement of the heat seals will preferably ensure that, when the sheets are laid flat, the sections of the sheet material bordering the skewed-cut edges 20, 20*a* between successive heat seals each include at least one portion of the first layer which does not overlap with the second layer and at least one portion of the second layer which do not overlap with the first layer. Preferably the heat seals are formed in pairs at about bag-width distances apart as shown in FIG. 1D. Most preferably, the heat seals may be placed at intersecting points of minimum deflection of the paths of severing from the centerline of the tube. However, a number of other embodiments are possible by placing the heat seals at other points along the tube halves.

Either simultaneously with the heat sealing or afterwards in a separate step, a transverse weakened area is created between the pairs of heat seals. This weakened area may take the form of a perforation if the bags will be convolutely wound into rolls. The roll of bags may be dispensed by tearing at the perforation. As an alternative embodiment it may be such that the sheets of material are severed between the heal seals so as to form individual bags. In either embodiment, when the bags are laid flat, each comprises a top layer, a bottom layer, a folded straight closed edge, a skewed-cut open edge and two heat sealed side edges. The side edges are boarded by the heat seals. Sections of the bag material bordering the skewed-cut open edge are folded and stacked and then boxed. As an alternative embodiment of practicing the present invention the thermoplastic tube halves may be separated into two streams of material immediately after leaving the severing section 13. The two streams may then be processed separately as described above to form either a roll of bags connected by perforated areas of weakness or to form individual bags.

Figure 2A:
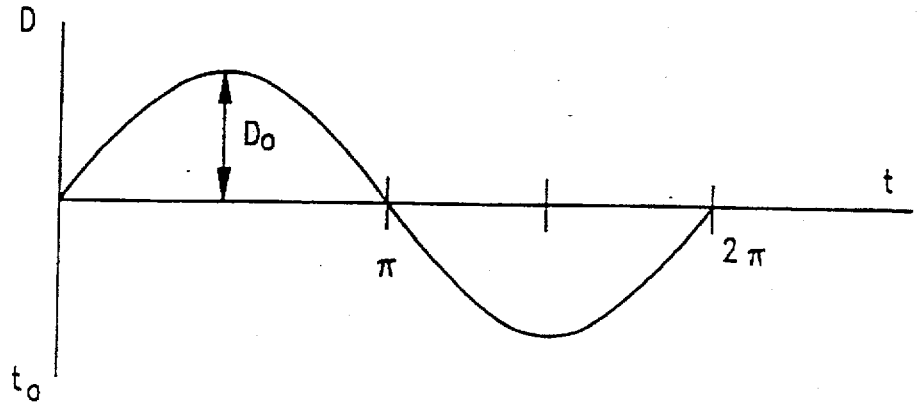
FIGS. 2A, 2B, and 2C show three curves which illustrate simple harmonic motion.
Figure 2B:
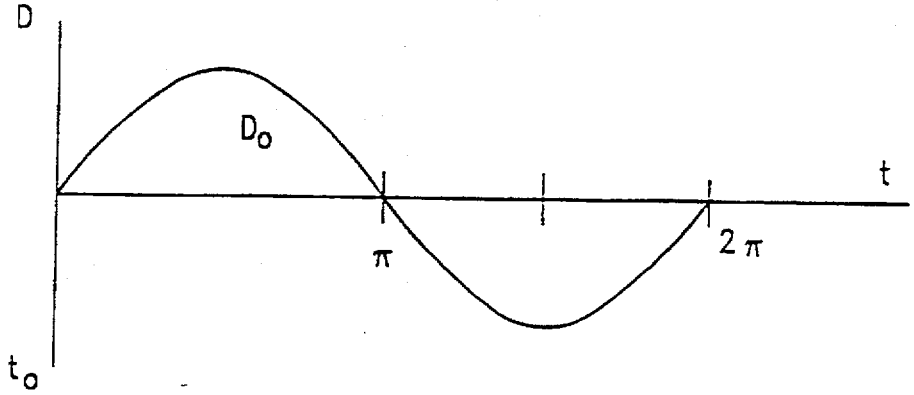
Figure 2C:
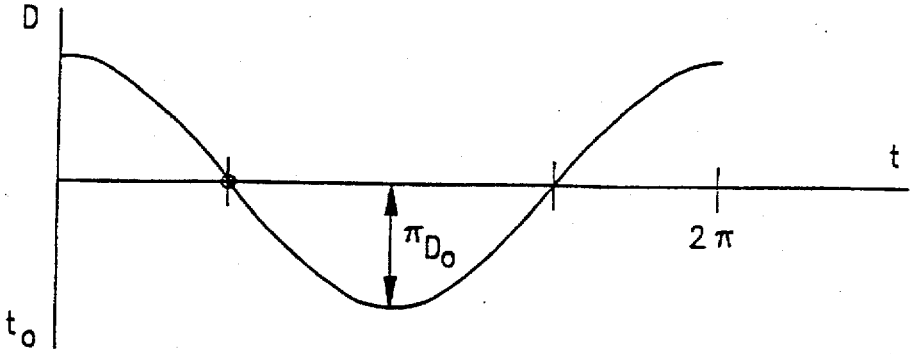

As stated herein above, the two independent cutting means sever opposing sides of the flattened tube of thermoplastic material as the tube travels in the machine direction past a cutting section. The cutting means move from side to side in sinusoidal oscillating motion transverse to the flattened tube of thermoplastic material. This motion and the resulting severing path is called simple harmonic oscillation and can be described by the equation:

$$D=D_0(\sin 2\pi ft+\theta)$$

where $D_O$ is the maximum displacement or amplitude of the severing path from a centerline, f is the frequency of oscillation, t is time and θ is the phase angle of the simple harmonic. It should be noted that the term centerline refers to the centerline of oscillation and is not limited to the centerline of the thermoplastic tube. The phase angle has little meaning with respect to a single harmonic oscillator and in fact can be said to have a value of zero therefor. However, phase angle is of critical importance for describing and comparing two harmonic oscillators and accordingly the path of severing of the first and second layers. When two harmonic oscillators have the same phase angle they travel along the same path at the same time. They are said to be in phase. That is they reach points of maximum amplitude from centerline at the same time. FIGS. 2A and 2B illustrate two paths of harmonic oscillation that are in phase. The vertical axis displays the amplitude of the path of severing from the centerline of oscillation. The horizontal axis displays time. At time $t_0$ this amplitude is at a minimum. Following the paths of severing to time $2\pi$, it can be seen that they reach maximum amplitude or displacement, $D_O$, to either side of centerline at identical times. As applied to this invention, two cutting means traveling in phase would track along exactly the same path at the same time as they severed the first and second layers of the collapsed tube of thermoplastic material. As a difference in the phase angle between the two harmonic oscillators is introduced and increased, the time at which they individually reach their points of maximum displacement from centerline will change. FIG. 2C illustrates a harmonic oscillator that has a different phase angle or is phase shifted from FIG. 2B. In this example, FIG. 2C is phase shifted by 90 degrees from FIG. 2B. The preferred embodiment of the present invention relates to intentionally creating a phase difference or phase shift between two cutting means following simple harmonic oscillation to create a thermoplastic bag having a novel easy to open feature. The phase shift creates single layer film regions at the mouth of the bag that may be pulled in opposite directions to open the bag. By varying $D_0$ value or amplitude of the oscillation and the placement of heat seals which form the sides of the bag, many different embodiments of the invention may be realized as will be explained in more detail herein below. In any embodiment, however, the bag will have a section of bag material bordering the skewed-cut edge where at least some portion of a first layer which does not overlap the second layer and at least some portion of a second layer which does not overlap the first layer.

Figures 3A, 3B, 3C:
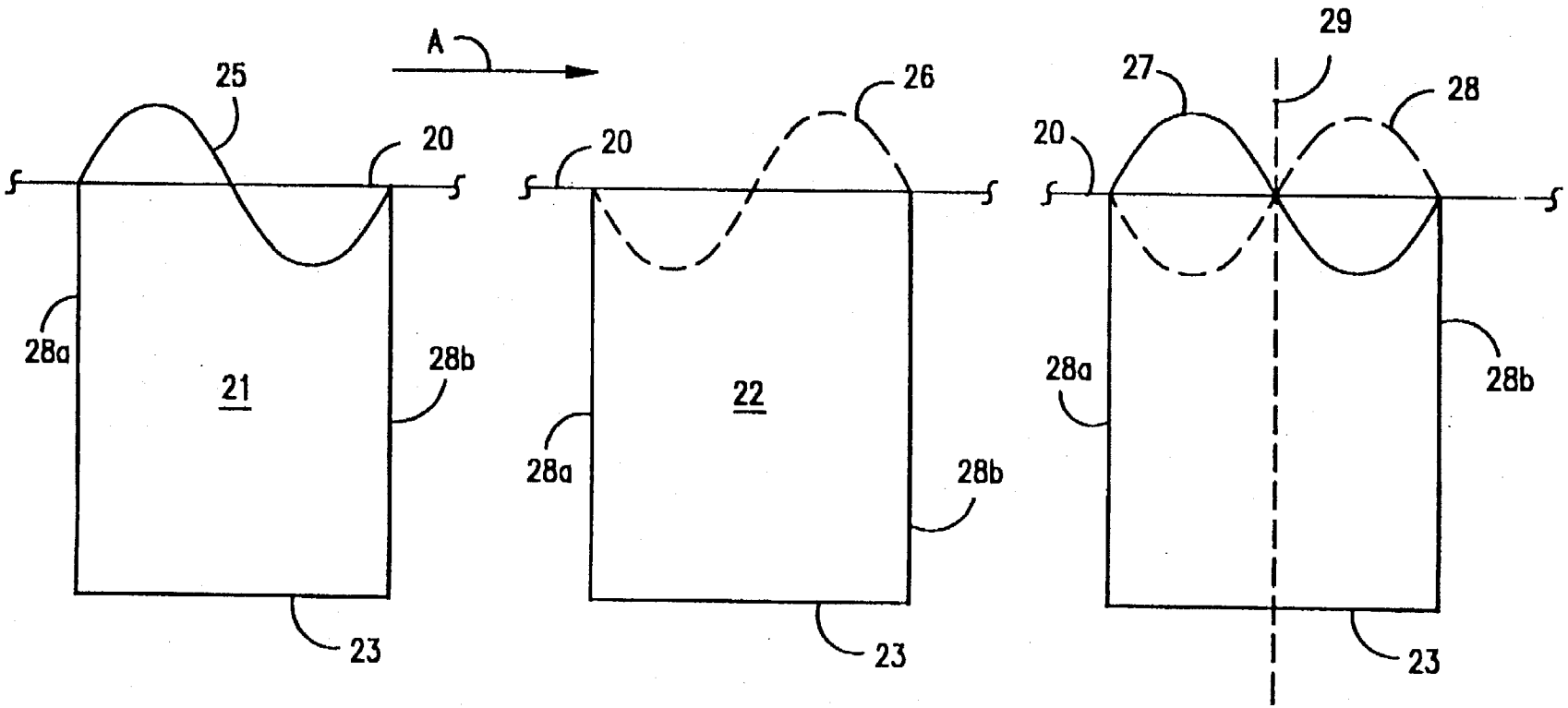
FIGS. 3A, 3B, and 3C are views of the individual severing steps that take place in the first and second layers of bag film.

Turning now to FIGS. 3A, 3B, and 3C, the effect of the phase difference as applied to the making of a preferred embodiment is illustrated by isolating one of the two halves 16. FIG. 3A isolates a first layer of one half 16 of the traveling tube of thermoplastic material moving in the machine direction A. The path of severing of the tube oscillates around the tube centerline 20. For clarity and purposes of illustration a portion of the tube first layer 21 is shown adjacent to a corresponding and underlying portion of the second layer 22 (FIG. 3B) of the tube making up the same bag. The tube fold edge 10 defines the bottom of the bag. The side edges **28*a*, 28*b* of the bag are defined by the transverse heat seals 15 (See FIG. 1). The first layer path of severing 25 (FIG. 3A) can be seen to move from the centerline of the tube upwards and then downwards in the transverse direction to points of maximum displacement from centerline returning to the centerline. The movement from the first side edge 28*a* to the second side edge 28*b* of the bag defines one cycle of oscillation. The second layer path of severing 26 (represented in FIG. 3B by a dashed line) follows the same type of oscillation but is phase shifted from the first layer path of severing. The second layer path of severing 26 moves downwards and then upwards in the transverse direction to equivalent points of maximum displacement returning to centerline at the same point on the collapsed tube. The first and second layers are shown in alignment in FIG. 3C. It can be readily appreciated that the oscillation phase difference between the path of severing of the first layer 21 and the second layer 22 creates a portion of the first layer that does not overlap with the second layer and a portion of the second layer that does not overlap the first layer. In this embodiment there is created an alternating series of opposing, laterally offset integral tie members illustrated by 27 and 28. The first upper layer tie member 27 is laterally offset from the central vertical axis 29 of the bag. The second lower layer tie member 28 is also laterally offset from the central vertical axis but is located in opposing relationship to the first layer tie member. Note that due to the 180 degree phase shift and the location of the heat seals at intersecting points of minimum deflection, the members will always be laterally offset from the central vertical axis 29** of the bag and from each other. It can also be seen that an identical tie member structure will be created in bags formed on the opposing tube half. It follows that any bag taken from one half of the traveling tube will have an identical structure to any bag taken from the opposing half of the tube. This condition holds true whether the bags are either in the lay flat with the side edges bordered by the heat seals or in the open condition.

The configuration shown in FIGS. 3A–3C is not intended to limit the reach of this invention. Phase differences of other magnitudes can be combined with alternate placements of the heat seals to create a number of widely varying embodiments as is illustrated herein below. The scope of this invention includes introducing a sufficient phase shift between two sinusoidally oscillating paths of severing to create a portion of the first layer that does not overlap the second layer and at least a portion of the second layer that does not overlap the first layer. That portion in each layer is preferably large enough to be grasped and pulled apart to open the bag for loading.

Figure 4:
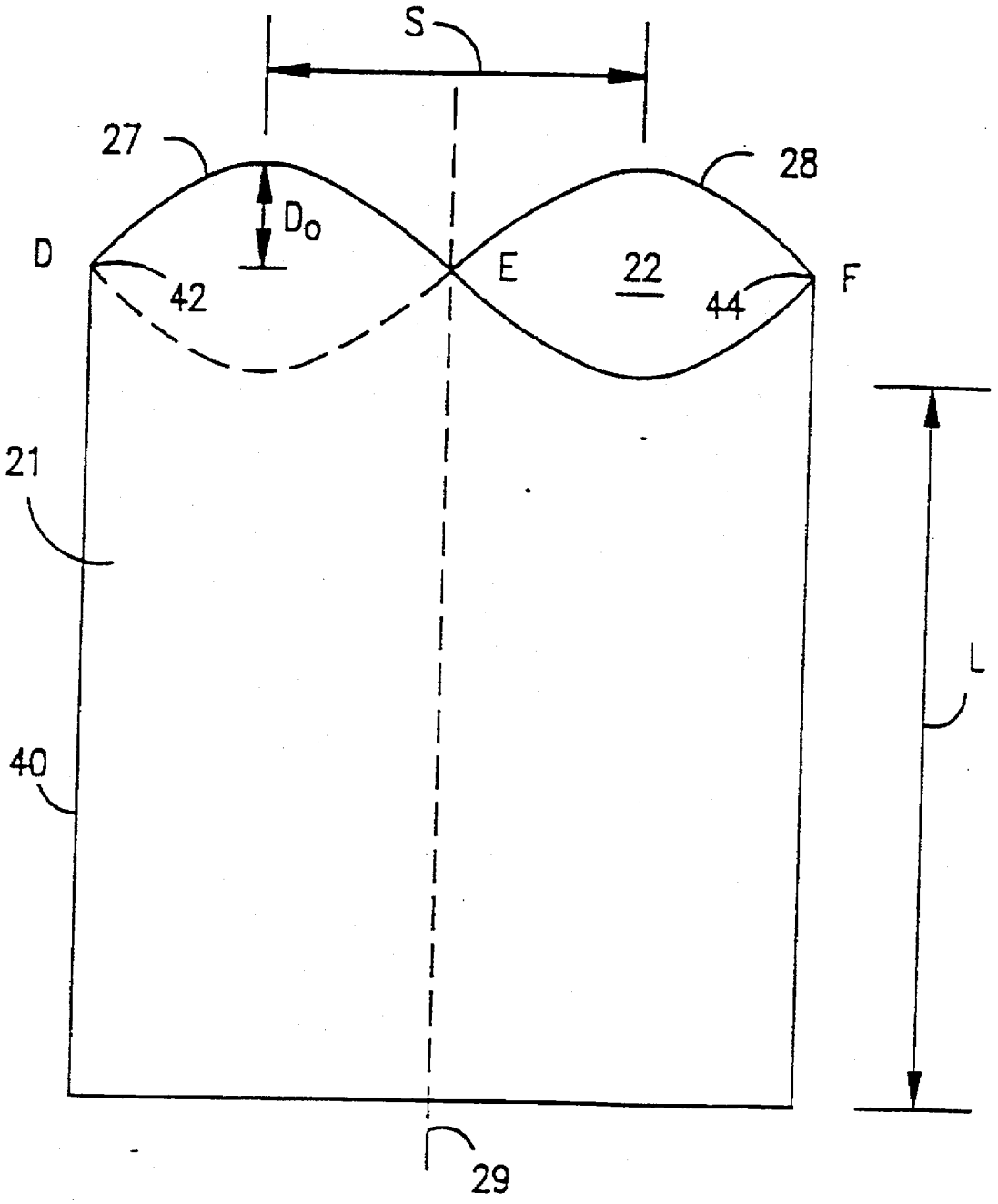
FIG. 4 is an elevation view of the completed bag.

The simple harmonic oscillation of the present invention is characterized by a particular frequency. Typically, frequency is expressed as cycles per second with a cycle defined as one complete oscillation from zero deflection through two maximum deflections and back to zero deflection. The preferred embodiment shown in FIG. 4 can be described as being one cycle wide from heat sealed edge to heat sealed edge. Accordingly, the number of cycles per unit time will determine the number of bags produced per unit time. This frequency may be adjusted depending on the size of bag to be produced. The heat sealing station may be synchronized with the cutting means to operate at this frequency to ensure that the heat sealed edges of the bags are located at the beginning and at the end of each cycle or each number of cycles. In the embodiment of FIG. 4 the heat seals are positioned along the tube at points where the paths of severing of the first layer and the second layer intersect. These points are shown in FIG. 4 at 42 and 44.

Turning now to FIG. 4, the preferred embodiment is illustrated in the layflat condition. The term lay flat condition is defined as the bag in a collapsed condition before it has been opened for filling. It is a condition such that, when the bag is laid flat, the heat seals of the sides which intersect with the mouth of the bag form the bag side boundaries. The shape of the leading edge of the bag mouth contained in the first layer 21 does not overlap with the shape of the leading edge of the bag mouth contained in the opposing second layer 22. As a result of the novel phase shifted cutting method employed, at least some portion of the first layer 21 does not overlap the second layer 22 and at least some portion of the second layer 22 does not overlap the first layer 21. In this embodiment the leading edges have equal amplitude and frequency but are phase shifted. Preferably a phase shift of about 180 degrees is introduced between the cutting means. The bag has a generally symmetrical shape about a central vertical axis 29 with integral tie members 27 and 28 formed by the non-overlapping portions described above. The tie members extending upwardly from the first layer 21 and the second layer 22. The members are defined by the single layer regions at the top of the bag and have a generally sinusoidal shape. The single layer regions are defined as that portion of the first layer 21 projecting above the curved line DE in the second layer 22 and that portion of the second layer 22 projecting above curved line EF in the first layer 22. The width of each single layer region is equal to half the bag width and the height thereof is equal to twice $D_0$. The present invention is not limited to symmetrical single layer regions, however. As the phase shift is varied from 180 degrees it is possible to have non-symmetrical single layer film regions. The members 27,28 are laterally offset from each other and from the vertical central axis 29 in opposing relationship by the amount of the phase difference between the two oscillations that created them. The size of the members can be varied to meet a particular application by varying the member length during manufacture. Member length is defined as $D_O$, the maximum deflection or amplitude of the path of severing of the collapsed tube of thermoplastic material.

In accordance with this invention a great deal of flexibility in bag design is provided. This flexibility is illustrated by the three embodiments described in Table I below. The Table gives desirable dimensions for bags of 4 gallon, 13 gallon, and 30 gallon capacity. Bag length is defined as the dimension from the bottom of the bag to the lowest point of the oscillation of the paths of severing and is shown as dimension L in FIG. 4. Member separation is shown as dimension S in FIG. 4 and is the horizontal distance separating the points of maximum deflection of the individual paths of severing.

TABLE I

| | 4 Gallons | 13 Gallons | 30 Gallons |
|---|---|---|---|
| Bag Width | 17 | 24 | 30 |
| Bag Length | 16 | 28 | 34 |
| Member Separation | 8.5 | 12 | 15 |

In these preferred embodiments member length may be varied from about 2 inches to about 4 inches. Most preferable is a member length of about 3 inches for the 13 gallon and 30 gallon bag sizes. For the 4 gallon size bag a member length of about 2.5 inches is most preferable. However, these member lengths are intended as non limiting examples only. As will be well appreciated by a person of ordinary skill in the art, member length may be adjusted as needed for a particular application.

Figure 5:
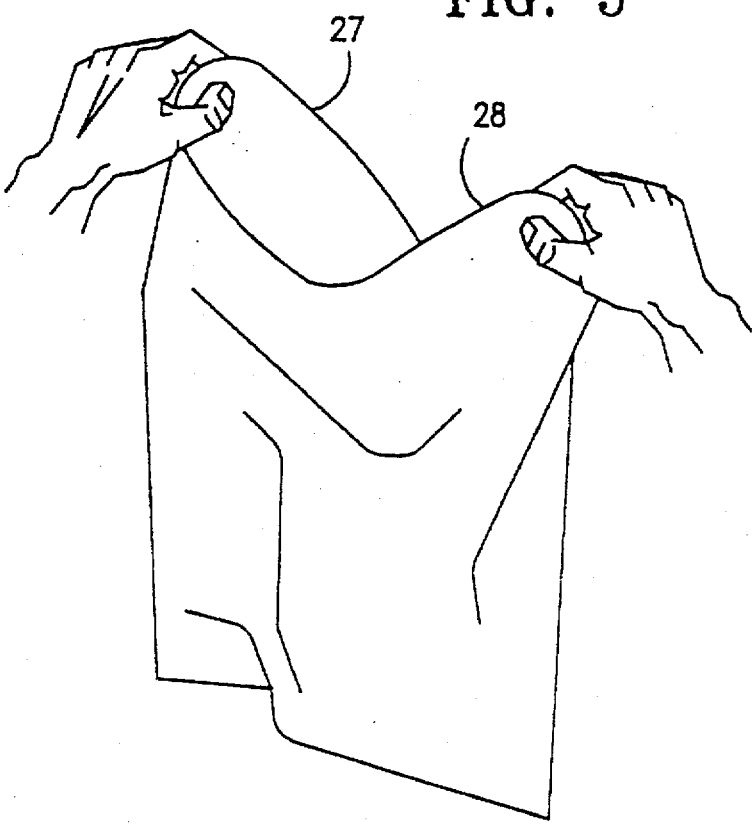
FIG. 5 is a perspective view of the completed bag illustrating the easy open feature.
Figure 6:
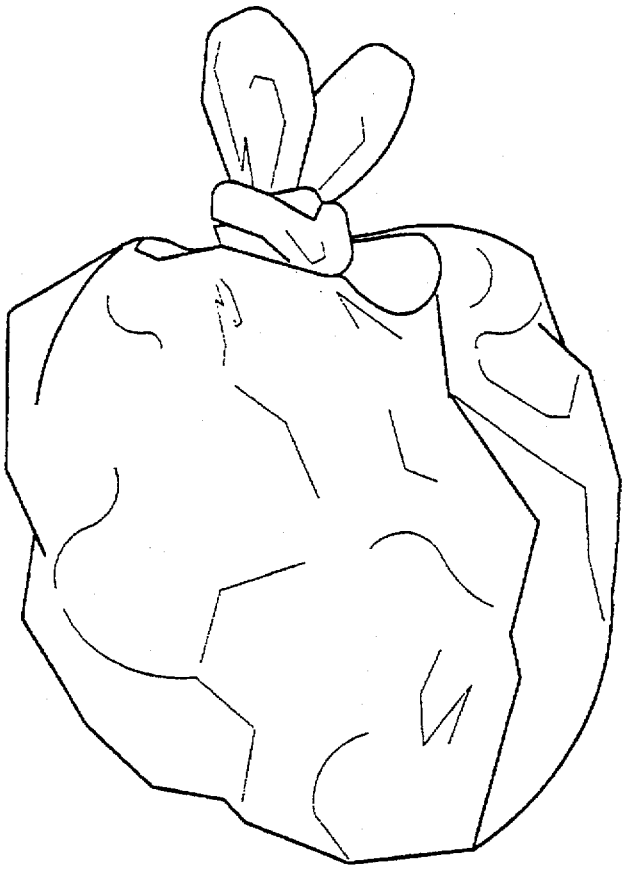
FIG. 6 is a view of a fully loaded and tied bag.

The novel easy open feature of the present invention is illustrated in FIG. 5. The user opens the bag by grasping the single layer tie members 27 and 28 and pulling them in opposite directions. Because the tie members are integral extensions of the two bag layers, the pulling action readily opens the bag. The pulling force thus generated overcomes any tendency of the two layers of the bag to adhere to each other. Even thin gage thermoplastic material may be easily separated by pulling apart the opposed tie members. After loading the bag, the tie members are pulled toward each other to close the open mouth of the bag and then tied together to effect closure. The closed bag is illustrated in FIG. 6. An important advantage of the present invention over the prior art is that one strong carrying member is created making it easy for the sometimes heavily loaded bags to be picked up and transported. Moreover, the consumer need tie only a single pair of members to close the bag. Prior art bag tie arrangements require the consumer to use two pairs of tie members.

Another advantage of the present invention addresses the problem that consumers encounter with rectangularly shaped bags. With that type bag, it can be very difficult to distinguish the top of bag from the bottom of the bag. This result is due to the very clean separating cut possible with current technology and also to the cut blocking that tends to cause the film layers making up the bag to adhere to each other. The offset tie members of the present invention address that problem by signaling to the consumer the location of the top of the bag. The immediately recognizable contrast in shape between the top and the bottom of the current bag directs the consumer to the end of the bag that should be opened greatly decreasing the frustration encountered in using the bag.

Figure 7:
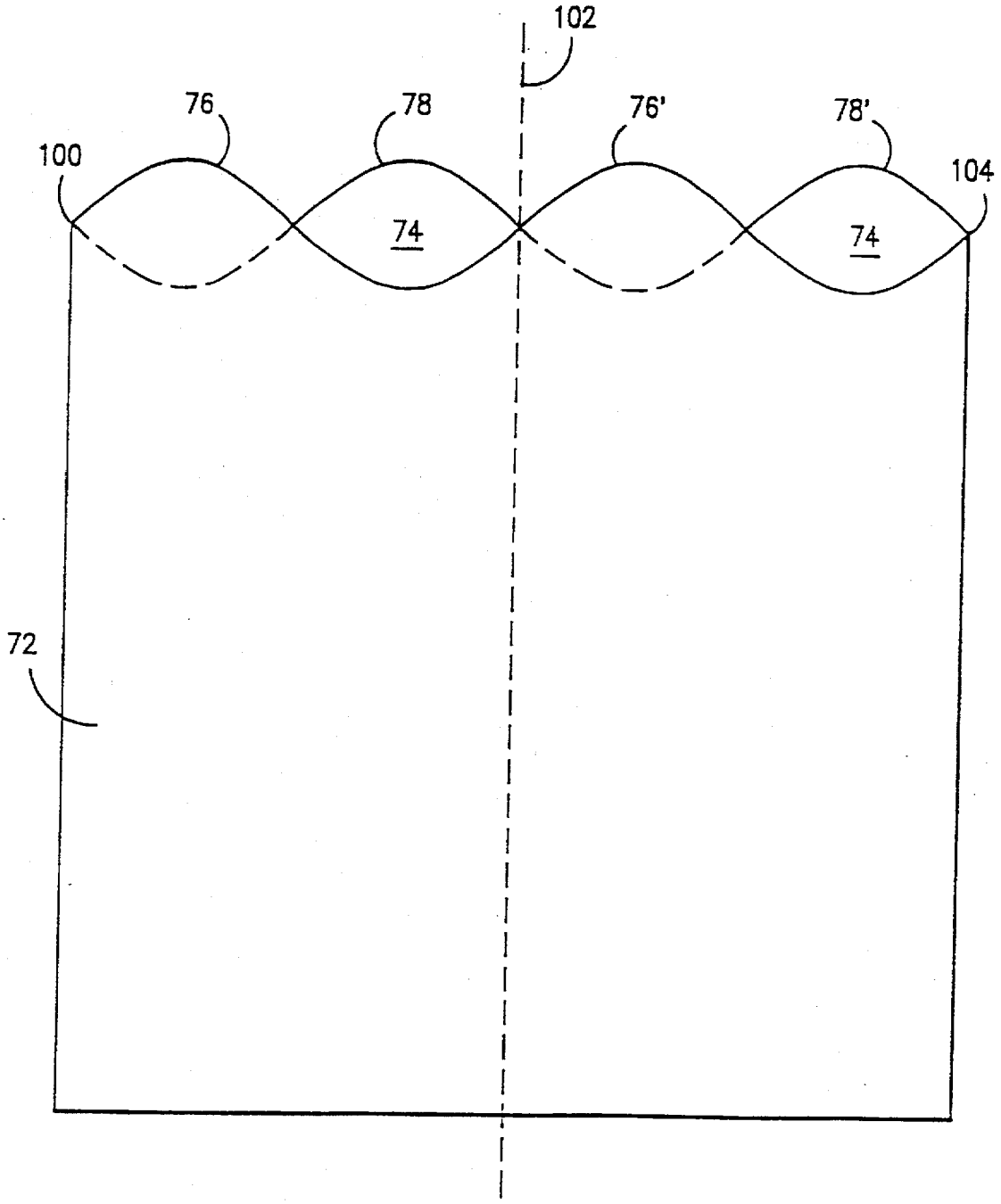
FIG. 7 is a view of an alternative embodiment having tie handles in the shape of a truncated cone.

An alternative embodiment of the present invention is shown in FIG. 7. This bag also has a first layer, a second layer, three joined sides and an open mouth. The bag has a second tie member in the first upper layer and a second tie member in the second lower layer. Accordingly, this bag contains two integral tie members 76 and 76' (shown by the solid line) in the first upper layer 72 and two integral tie members 78 and 78' (shown by the dashed line) in the second lower layer 74. The path of severing used to create the tie members follows the harmonic oscillator model described above to include a 180 degree phase difference between oscillators. However, this embodiment contains two cycles of oscillation per bag width. Moving from left to right across the bag, one cycle is formed from the bag edge at 100 to the bag central vertical axis 102 and a second cycle is formed from the vertical central axis 102 to the opposing bag edge 104. The net effect is to define a first pair of members 76 and 78 laterally offset to one side of the vertical central axis 102 and a second pair of members 76' and 78' laterally offset in opposing relationship on the opposing side of the vertical central axis 102. The two members in the first pair of members are laterally offset from each other as are the two members in the second pair. Upon close inspection it can be seen that the bag of FIG. 7 can be created by placing two of the bags shown in FIG. 4 side by side. Accordingly one possible but non-limiting use of the FIG. 7 embodiment would be for a larger, higher capacity bag.

Figure 8:
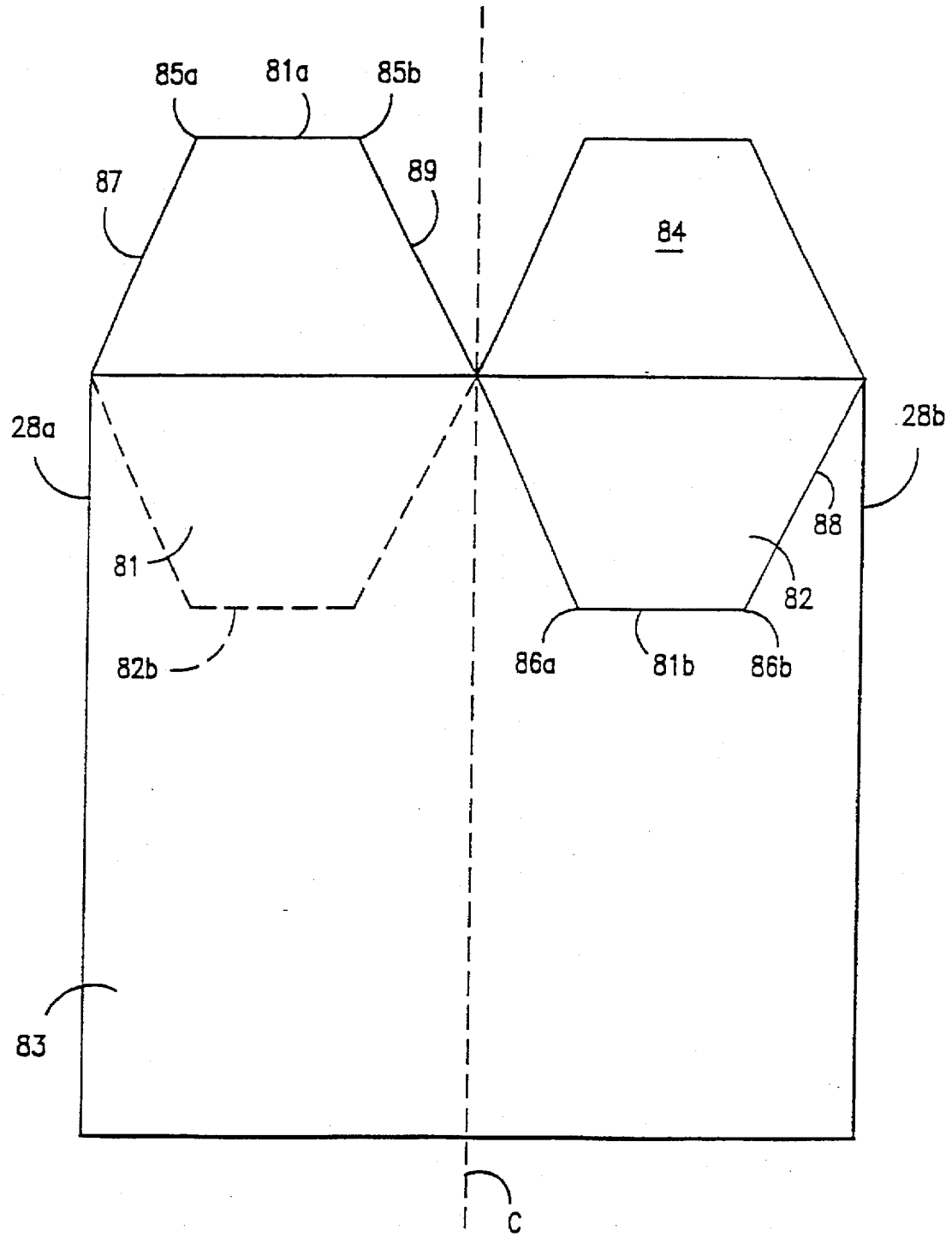
FIG. 8 is an elevation of an alternative embodiment having four tie handles.

An alternative embodiment of an easy opening bag 80 is shown in FIG. 8. Here again the tie members are arranged in a opposing relationship about the central vertical axis C of the bag. The laterally offset tie members 81 and 82 have a truncated cone shape in this embodiment. When the bag is in a lay flat condition, single layer film regions 81, 82 are defined in the first upper layer 83 and in the second lower layer 84. The use of these regions to open the bag is the same as that shown in FIG. 5. Each tie member is defined by upper and lower lands connected to angled sides. The upper layer tie member 81 comprises a flat upper land **81*a* having a first end 85*a* and a second end 85*b*, a first short angled side 87 extending downwardly from the first end 85*a* of the flat upper land 81*a*, and a long angled side 89 extending downwardly from the second end 85*b* of the flat upper land 81*a*. The first short angled side terminates at the first side edge 28*a*. The long angled side 89 terminates at the lower land 81*b* at a first end 86*a*. From the second end 86*b* of the lower land 81*b* there extends upwardly a second short angled side 88. The upwardly extending second short angled side terminates at the second side edge 28*b*. Two short angled sides converge at each side edge 28*a*, 28*b* of the bag. One of those short angled sides extends downwardly from an upper land in a first tie member and the second extends upwardly from a lower land in the opposing tie member. The second lower layer tie member 82 in configured in an identical fashion to the first upper tie member 81** but is located on the opposing side of the bag central axis C.

Figure 11:
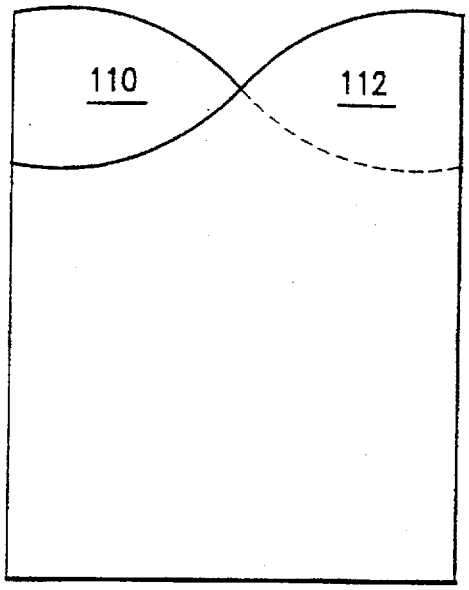
FIG. 11 is an elevation view of a bag of the present invention having side edge seams positioned at points of maximum deflection of the paths of severing.
Figure 12:
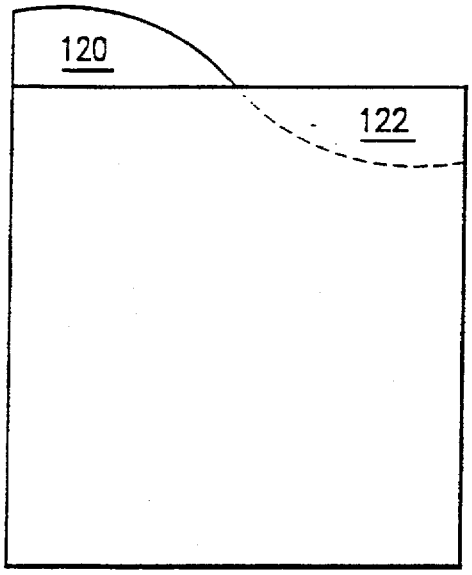
FIG. 12 is an elevation view of the bag of a present invention having one layer which is sinusoidally severed and an opposing layer which is straight cut.
Figure 13:
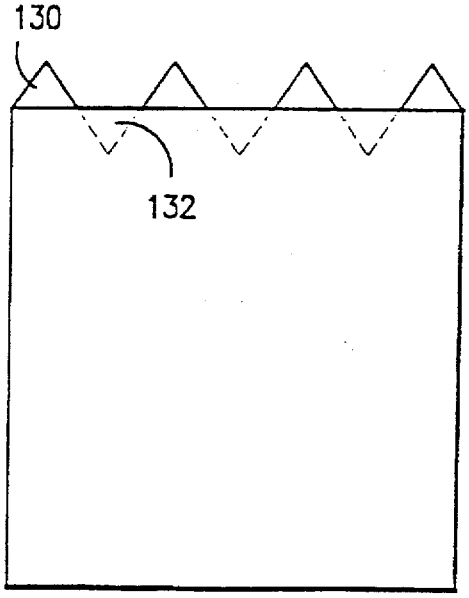
FIG. 13 is an elevation view of a bag of the present invention having one layer which has a sawtooth severance and an opposing layer which is straight cut.

Referring now to FIGS. 11–15, a number of possible embodiments of the present invention are illustrated. Each of these embodiments has at least one single film layer region wherein at least a portion of the first layer does not overlap the second layer and a portion of the second layer that does not overlap the second layer. FIG. 11 depicts a bag having sinusoidal leading edges in both layers encompassing a half cycle of oscillation. In this bag the heat sealed side edges do not intersect the bag mouth at points of intersection of the sinusoidally shaped cuts but rather at points of maximum separation of the cuts. The two single layer film regions 110, 112 thus formed may be used to open the bag for filling. If the amplitude of oscillation is large enough those regions may also function as tie members to close the bag and form a handle for carrying.

The next two Figures illustrate the coupling of a layer having a straight cut leading edge with an opposing layer having either a sinusoidal leading edge (FIG. 12) or a sawtooth cut leading edge (FIG. 13) on the opposing layer of material. Each of these embodiments is useful to open the bag for filling but do not offer the additional advantage of providing a tie member. Accordingly, the amplitude of oscillation used in FIG. 12 can be reduced to the minimum required to provide single film layer regions 120, 122 capable of opening the bag. The triangularly shaped single layer film regions 130, 132 illustrated in FIG. 13 should likewise be of sufficient size such that the bag may be opened as shown in FIG. 5.

Figure 14:
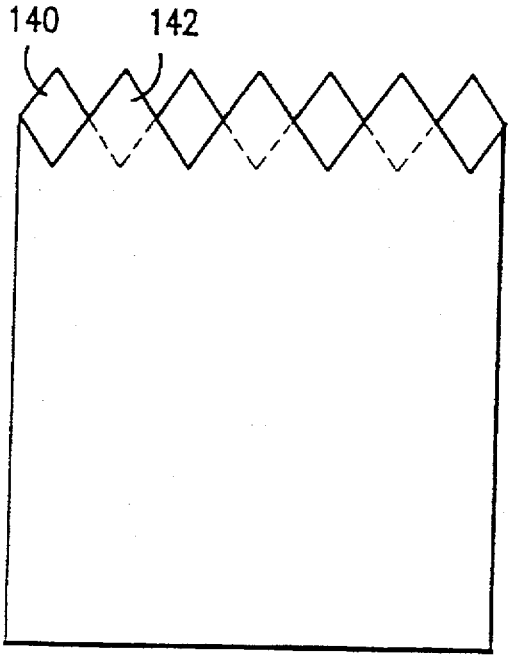
FIG. 14 is an elevation view of a bag of the present invention having two layers which have a sawtooth severance.

FIG. 14 shows an alternating series of sawtooth members in each layer of the bag. Here the single film layer regions 140, 142 are diamond shaped but function in an identical manner to that described herein above to open the bag for loading. The size and number of the sawtooth members may be varied to provide a tie member for the bag.

Figure 15:
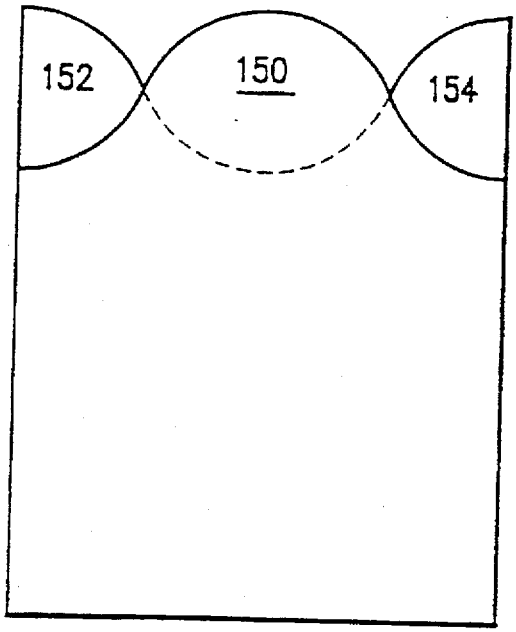
FIG. 15 is an elevation view of an alternative embodiment of a bag of the present invention having side edge seams positioned at points of maximum deflection of the paths of severing.

Turning now to FIG. 15 another sinusoidal embodiment of the bag is shown. The phase shift between the oscillating cutting means and the placement of the heat seals has been combined to create a single layer film region 150 centered on the center of the bag. Laterally offset single layer film regions 152 and 154 cooperate with region 150 to open the bag.

Figure 9:
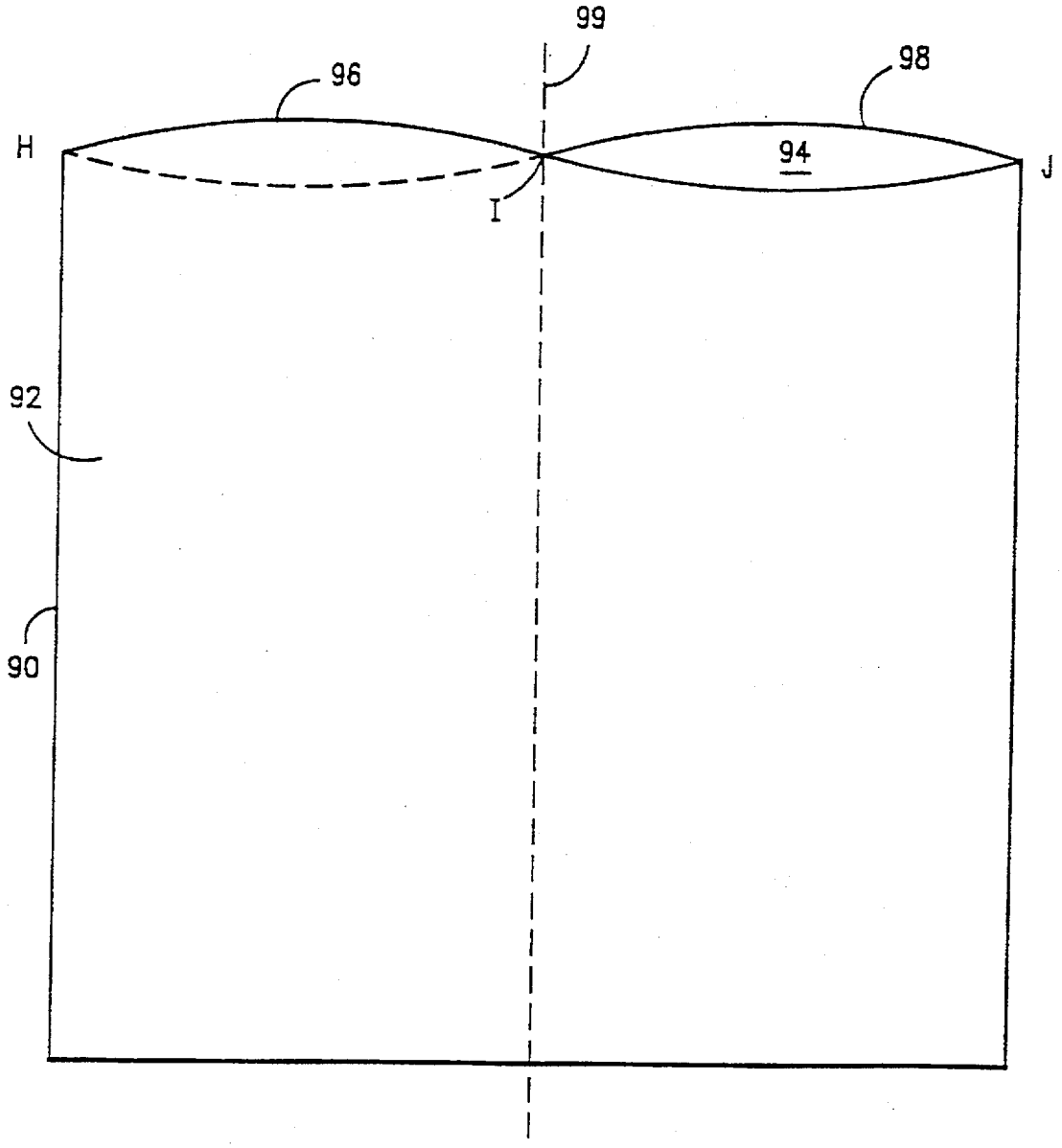
FIG. 9 is an elevation of a no tie handle embodiment of the present invention.

A preferred embodiment of a bag incorporating the easy open feature is shown in FIG. 9. The bag 90 has a first upper layer 92 and a second lower layer 94 with sinusoidal undulations 96 and 98 extending upwardly from the first upper layer 92 and second lower layer 94 respectively. The undulations also follow the harmonic oscillator model discussed herein above but have a much reduced amplitude, $D_O$. Holding the frequency of oscillation f constant at one cycle per bag width, as $D_O$ is reduced, the appendage thus formed is reduced in size to the point that it no longer performs adequately the tie function. There remains a single film layer region at the top of the bag, that region characterized by one undulation in the first layer and one undulation in the second layer. The undulations are each laterally offset from the bag vertical central axis 90 to form an opposing relationship with each other. As used herein, the term undulation should be understood to mean sinusoidal deflections that are substantially less than those of the embodiment previously discussed. An undulation cannot serve to tie the bag closed to the satisfaction of the consuming public. In a bag of width of about 17 inches and length of about 18 inches, a $D_O$ value of about 0.125 to about 0.50 inches could be used. In a preferred embodiment a $D_O$ value of about 0.25 inches is appropriate. As can be appreciated by one of ordinary skill in the art, a wide range of undulation configurations beyond this limited example can be achieved. As a general guideline, an undulation should have a sufficient $D_O$ value to provide the consumer with an easy to grasp single film layer region when opening the bag. That expansion in range is possible because the phase shift need be just large enough to create single layer film regions of sufficient size to be grasped by human fingers. The preferred phase shift for the undulation embodiment is 180 degrees.

A consumer desiring to open the bag may grasp the single film layer undulations 96 and 98 and pull them in opposite directions to separate the first layer from the second layer and thus open the bag. As was the case with the integral tie member embodiments, the single layer region is defined by the leading edge along curved line HI in layer 94 and the leading edge along curved line IJ in layer 92.

Figure 10:
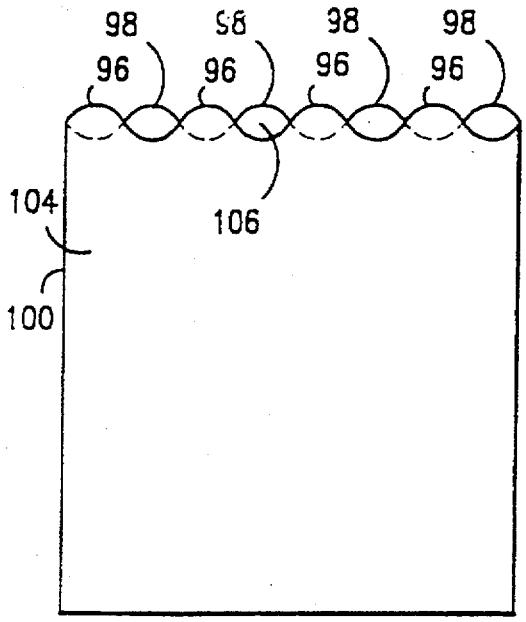
FIG. 10 in an elevation of an alternative embodiment of the no tie version of the present invention.

An alternative no tie member embodiment of the present invention is presented in FIG. 10. This bag 100 features four undulations in both the first upper layer 104 and the second lower layer 106. The undulations in this embodiment would typically have a greater $D_O$ value than those in FIG. 9 but would still be too small to function adequately as tie members. Each of the first layer undulations 106 is offset from an adjacent second layer undulation 108. Single layer regions are formed at the top of the bag as is the case with the other embodiments of the present invention.

Any thermoplastic material suitable for either refuse or bulk storage may be used to make the present invention. Preferred materials include the family of polyethylenes to include high density and low density polyethylene. Particularly preferred is linear low density polyethylene (LLDPE). LLDPE is an ethylenic copolymer formed by copolymerizing ethylene with a minor proportion by weight of an alpha olefin monomer containing 4 to 10 carbon atoms. The use of LLDPE in garbage bags has permitted manufacturers to increase strength, puncture resistance and tear resistance properties. By way of example not intended to limit the scope of the present invention, typical film thicknesses used for bags of the present invention are from about 0.3 mil to about 1.5 mil.

Forming members in wave-like fashion as described herein is advantageous in continuous manufacturing. In addition to the features already described, member reinforcements may be employed according to the method disclosed in Suominen, U.S. Pat. No. 4,125,220, the contents of which are incorporated herein by reference.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A method for making a web of interconnected thermoplastic bags, comprising the steps of:

supplying a flattened tube of thermoplastic film traveling in a longitudinal direction parallel to an axis of said tube, said flattened tube having opposing top and bottom sides;

providing first and second cutting means, at least one of said cutting means oscillating in a transverse direction that is generally perpendicular to said longitudinal direction;

using said first and second cutting means to cut said respective top and bottom sides along respective cutting paths so as to divide said tube into two halves, said first and second cutting means being constructed such that said first cutting means only cuts said top side and said second cutting means only cuts said bottom side, each of said halves including a top layer, a bottom layer, and a straight-folded longitudinal edge joining said top and bottom layers, said top and bottom layers of each of said halves including respective mouth edges opposing said straight-folded longitudinal edge and formed by said respective cutting paths, at least one of said mouth edges being skewed, said cutting paths being substantially non-superposed with each other such that at least one portion of said mouth edge of said top layer does not overlap said mouth edge of said bottom layer and at least one portion of said mouth edge of said bottom layer does not overlap said mouth edge of said top layer; and forming pairs of transverse heat seals at bag-width distance apart in each of said halves.

2. A method according to claim 1 further comprising severing each of the halves between the pairs of transverse heat seals so as to form individual bags.

3. A method according to claim 1 further comprising perforating each of the halves between the pairs of transverse heat seals so as to form continuous sheets of bags.

4. A method according to claim 1, wherein each of said cutting paths oscillate in a harmonic mariner such that sinusoidal shaped cuts are made in said top side and said bottom side.

5. A method according to claim 4, wherein said sinusoidal shaped cuts are 180 degrees out of phase.

6. A method according to claim 5, wherein the transverse heat seals formed intersect with points of intersection of said sinusoidal shaped cuts.

7. A method according to claim 6, wherein, between the transverse heat seals, no more than one portion of said mouth edge of said top layer does not overlap with said mouth edge of said bottom layer and no more than one portion of said mouth edge of said bottom layer does not overlap with said mouth edge of said top layer.

8. A method according to claim 7, wherein each bag is defined by a plurality of transverse widths, said transverse widths varying according to the skew-cut edge, each side having points of maximum transverse width and points of minimum transverse width, the maximum transverse width being at least 2 inches greater than the minimum transverse width such that located at said points of maximum transverse width are integral tie members particularly adapted for being tied together to close the bag and form a carrying handle after the bag is filled.

* * * * *